US009194108B2

(12) United States Patent
Fleury, Jr. et al.

(10) Patent No.: US 9,194,108 B2
(45) **Date of Patent: *Nov. 24, 2015**

(54) FLUSHING HYDRANT WITH FAIL-SAFE

(71) Applicant: Mueller International, LLC, Atlanta, GA (US)

(72) Inventors: Leo W. Fleury, Jr., N. Smithfield, RI (US); Normand James Roy, Coventry, RI (US); James Ola Williams, Marlborough, MA (US); Kenneth A. Clark, Chattanooga, TN (US); Paul Gifford, Chattanooga, TN (US); Christian Michael Granata, Stoughton, MA (US); Edward C. Parish, North Reading, MA (US)

(73) Assignee: Mueller International, LLC, Atlanta, GA (US)

( * ) Notice: Subject to any disclaimer, the term of this patent is extended or adjusted under 35 U.S.C. 154(b) by 90 days.

This patent is subject to a terminal disclaimer.

(21) Appl. No.: 13/841,597

(22) Filed: Mar. 15, 2013

(65) Prior Publication Data

US 2013/0206241 A1 Aug. 15, 2013

Related U.S. Application Data

(63) Continuation-in-part of application No. 13/760,804, filed on Feb. 6, 2013.

(60) Provisional application No. 61/595,737, filed on Feb. 7, 2012.

(51) Int. Cl.
*E03B 9/02* (2006.01)
*E03B 9/04* (2006.01)

(52) U.S. Cl.
CPC ... *E03B 9/02* (2013.01); *E03B 9/04* (2013.01); *Y10T 137/0318* (2015.04); *Y10T 137/5438* (2015.04)

(58) Field of Classification Search
CPC ..... E03B 7/12; E03B 9/02; E03B 9/14; A62C 35/22
USPC ..... 137/237, 238, 240, 72, 282, 288, 291, 137/296, 62, 63.6; 169/11, 16, 17, 61, 71; 134/166 C, 22.11, 22.12; 91/454
See application file for complete search history.

(56) References Cited

U.S. PATENT DOCUMENTS 2,262,489 A 11/1941 Bolser
2,580,197 A 12/1951 Schmid (Continued)

OTHER PUBLICATIONS

Fleury, Jr., Leo W.; Final Office Action for U.S. Appl. No. 13/760,804, filed Feb. 6, 2013, mailed Sep. 2, 2014, 19 pgs.

(Continued)

*Primary Examiner* — John K Fristoe, Jr.
*Assistant Examiner* — Kevin Barss
(74) *Attorney, Agent, or Firm* — Taylor English Duma LLP

(57) ABSTRACT

A device for flushing a hydrant includes a stem connected to a fluid valve of the hydrant and an actuation system including a biased translational system coupled to the stem, a compressed gas, and a normally-open gas discharge valve. An actuation system for flushing a hydrant includes a fluid, a piston assembly movable by the fluid, a manual bleed valve in communication with the fluid, and a biasing element at least indirectly biasing the piston assembly towards a stop position.

20 Claims, 13 Drawing Sheets

(56) References Cited

U.S. PATENT DOCUMENTS

| | | | | |
|---|---|---|---|---|
| 3,566,905 | A | 3/1971 | Noland | |
| 3,961,642 | A | 6/1976 | Thomas et al. | |
| 4,561,459 | A | 12/1985 | Jackman | |
| 4,706,929 | A | 11/1987 | Kalaskie et al. | |
| 4,989,830 | A | 2/1991 | Ratnik | |
| 5,201,338 | A | 4/1993 | McKeague | |
| 5,921,270 | A | 7/1999 | McCarty | |
| 6,129,002 | A * | 10/2000 | Lisec et al. | 91/454 |
| 6,356,811 | B1 | 3/2002 | Beselt | |
| 6,467,498 | B1 | 10/2002 | Esmailzadeh | |
| 6,627,089 | B1 | 9/2003 | Wilkinson | |
| 6,820,635 | B1 | 11/2004 | McKeague | |
| 6,868,860 | B2 | 3/2005 | Davidson | |
| 6,948,512 | B2 | 9/2005 | McKeague | |
| 7,473,359 | B1 | 1/2009 | Barrett, II | |
| 2002/0024033 | A1 | 2/2002 | Burkhardt | |
| 2006/0027265 | A1 | 2/2006 | Ball, Jr. et al. | |
| 2007/0075162 | A1 | 4/2007 | McKeague | |
| 2009/0178721 | A1 * | 7/2009 | Thompson | 137/625.48 |
| 2010/0032600 | A1 * | 2/2010 | Doe et al. | 251/129.15 |
| 2010/0065287 | A1 | 3/2010 | Burkhart et al. | |
| 2010/0121496 | A1 | 5/2010 | Paulus | |
| 2010/0163765 | A1 | 7/2010 | Gregoire | |
| 2010/0193715 | A1 | 8/2010 | Gethmann | |

OTHER PUBLICATIONS

Fleury, Jr., Leo W.; International Preliminary Report on Patentability for serial No. PCT/US2013/024928, filed Feb. 6, 2013, mailed Aug. 21, 2014, 9 pgs.

Fleury, Jr., Leo W.; International Search Report and Written Opinion for serial No. PCT/US14/19315, filed Feb. 28, 2014, mailed Sep. 2, 2014, 12 pgs.

Fleury, Leo W.; International Search Report and Written Opinion for serial No. PCT/US2013/024928, filed Feb. 6, 2013, mailed Apr. 5, 2013, 10 pgs.

Fleury, Jr., Leo W.; Provisional Patent Application Entitled: Flushing Hydrant, U.S. Appl. No. 61/595,737, filed Feb. 7, 2012; 19 pgs.

Fleury, Jr., Leo W.; Patent Application Entitled: Flushing Hydrant, U.S. Appl. No. 13/760,804, filed Feb. 6, 2013; 21 pgs.

Fleury, Jr., Leo W.; PCT Application entitled: Flushing Hydrant having serial No. PCT/US13/24928, filed Feb. 6, 2013, 27 pgs.

Parker Instrumentation; "Bleed/Purge Valves (BV & PG Series)", Catalog 4133-BP, Revised Feb. 2002, 6 pgs.

Fleury, Jr.; Leo W.; Non-Final Office Action for U.S. Appl. No. 13/760,804, filed Feb. 6, 2013, mailed May 21, 2014, 26 pgs.

Fleury, Leo W.; PCT Application entitled: Flushing Hydrant with Fail-Safe having serial No. PCT/US14/19315, filed Feb. 28, 2014, 38 pgs.

Fleury, Jr., Leo W.; Non-Final Office Action for U.S. Appl. No. 13/760,804, filed Feb. 6, 2013, mailed Jan. 8, 2015, 14 pgs.

Fleury, Jr., Leo W.; Final Office Action for U.S. Appl. No. 13/760,804, filed Feb. 6, 2013, mailed Jun. 8, 2015, 13 pgs.

Fleury, Jr., Leo W.; Applicant Interview Summary for U.S. Appl. No. 13/760,804, filed Feb. 6, 2013, mailed Jul. 21, 2015, 3 pgs.

Fleury, Jr., Leo W.; Non-Final Office Action for U.S. Appl. No. 13/760,804, filed Feb. 6, 2013, mailed Sep. 23, 2015, 32 pgs.

Fleury Jr., Leo W.; International Preliminary Report on Patentability for PCT/US14/19315, filed Feb. 28, 2014, mailed Sep. 24, 2015, 9 pgs.

* cited by examiner

FLUSHING HYDRANT WITH FAIL-SAFE

CROSS-REFERENCE TO RELATED APPLICATIONS

This application is a continuation-in-part of U.S. application Ser. No. 13/760,804, filed on Feb. 6, 2013, which claims priority to U.S. Provisional Application 61/595,737, filed on Feb. 7, 2012, both of which are hereby specifically incorporated by reference herein in their entireties.

FIELD

The current disclosure relates to fire hydrants. Particularly, the current disclosure relates to flushing of fire hydrants.

SUMMARY

A device for flushing a hydrant is disclosed and includes a stem connected to a fluid valve of the hydrant and an actuation system including a biased translational system coupled to the stem, a compressed gas, and a normally-open gas discharge valve.

Also disclosed is an actuation system for flushing a hydrant, wherein the actuation system includes a fluid, a piston assembly movable by the fluid, a manual bleed valve in communication with the fluid, and a biasing element at least indirectly biasing the piston assembly towards a stop position.

Also disclosed is a method of flushing a hydrant including operating an actuation system coupled to the hydrant, the actuation system including a compressed gas, a normally-open gas discharge valve, a piston assembly coupled to a stem of the hydrant; and a biasing element coupled to the stem, the stem connected to a fluid valve of the hydrant; closing the normally-open gas discharge valve; and opening the fluid valve of the hydrant by pressurizing one side of a piston plate of the piston assembly with the compressed air.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

DESCRIPTION OF THE FIGURES

The features and components of the following figures are illustrated to emphasize the general principles of the present disclosure and are not necessarily drawn to scale. Corresponding features and components throughout the figures may be designated by matching reference characters for the sake of consistency and clarity. Although dimensions may be shown in some figures, such dimensions are exemplary only and are not intended to limit the disclosure.

DETAILED DESCRIPTION

Disclosed are methods, systems, and apparatus associated with flushing fire hydrants.

The disclosure provides apparatus, methods, and systems for flushing a fire hydrant. The fire hydrant in various embodiments may be flushed using a fluid actuation system. The fire hydrant in various embodiments may be flushed from a remote location using a remote communicator.

It is common in municipal water systems to flush water through fire hydrants to ensure adequate flow and pressure to the hydrants and to remove sediment from the piping system. Often, this can be a labor-intensive task, requiring technicians to go into the field to perform the flushing operation for each hydrant in the piping system.

Most standard fire hydrants in the United States of America and in many other parts of the world are "dry barrel hydrants," meaning that the hydrant itself contains no water. Because fire hydrants are above-ground apparatus, a hydrant full of water could freeze and crack. Instead, water is flushed into the hydrant when it is needed.

Figure 1:
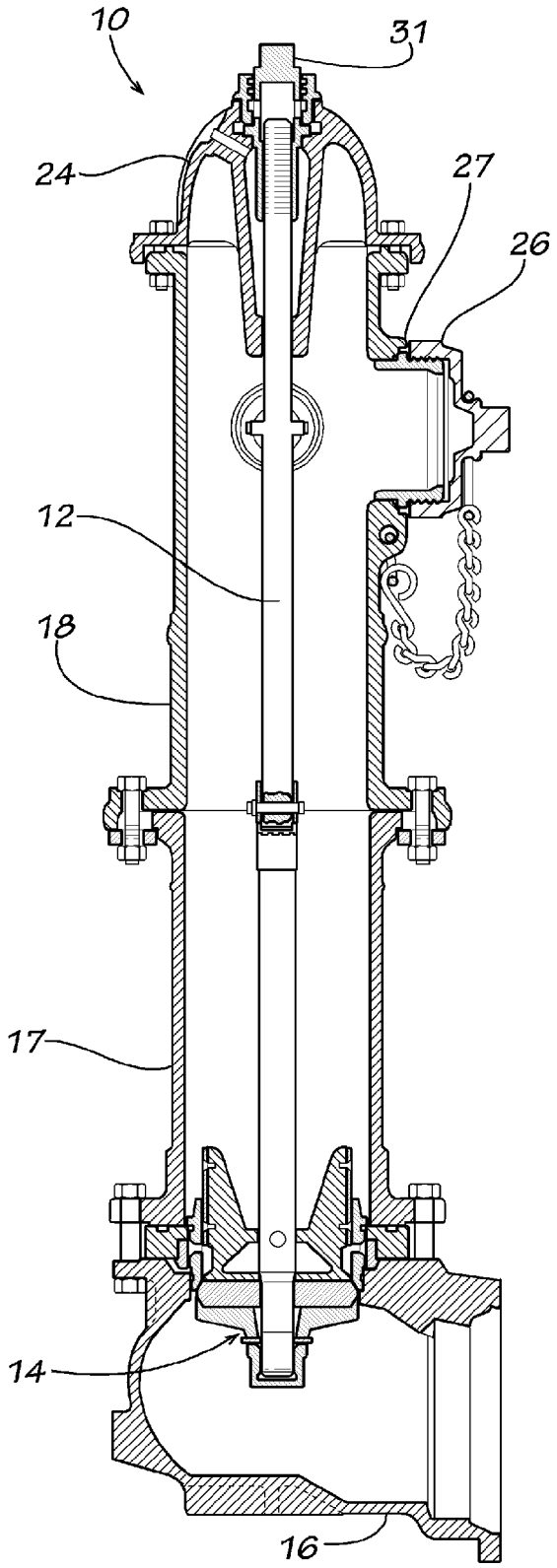
FIG. 1 is a cross-sectional view of a standard fire hydrant.

Standard fire hydrants, such as standard fire hydrant 10, seen in FIG. 1, contain a stem 12 that connects to a fluid valve 14 in a shoe 16. The shoe 16 is connected to a lower barrel 17. The lower barrel 17 is connected to the upper barrel 18. The upper barrel 18 is connected to a bonnet 24. A nozzle 27 is also seen on the upper barrel 18. The shoe 16 is in fluid communication with a water supply system, which is typically a municipal water supply. When water is needed or when the standard fire hydrant 10 needs to be opened to flush the water system, an operating nut 31 attached to the stem 12 is actuated to open the valve 14, thereby allowing water to flow into the lower barrel 17 and the upper barrel 18. A nozzle cap 26 can be removed to allow water to flush through the standard fire hydrant 10 or to provide water for firefighting or for other purposes. Typically, when a flushing operation is desired, a diffuser is connected to the nozzle 27 to reduce the velocity of the water stream exiting the standard fire hydrant 10, although a diffuser may not be necessary in all applications.

Figure 2:
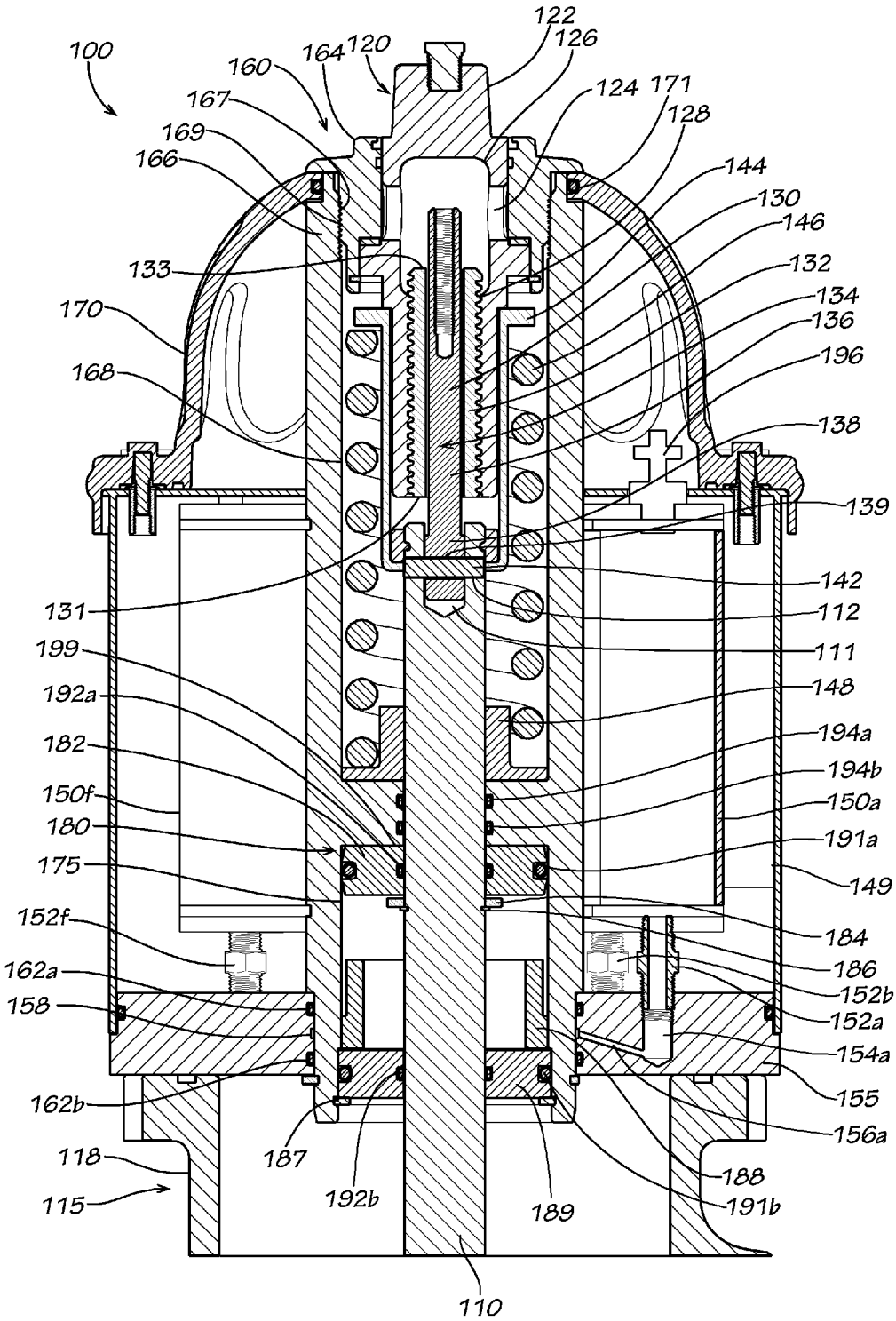
FIG. 2 is a cross-sectional view of a flushable hydrant in accord with one embodiment of the current disclosure in a resting state.

FIG. 2 is a cross-sectional view of a flushable hydrant 100 in accord with one embodiment of the current disclosure. The flushable hydrant 100 of the current embodiment includes an assembly of various pieces that permits electronic flushing of the flushable hydrant 100. In various embodiments, the flushable hydrant 100 includes an actuation system that includes a biased translational system for automated opening while maintaining a rotational manual override.

Seen in FIG. 2, much like a standard fire hydrant, the flushable hydrant 100 includes a stem 110 that communicates with a fluid valve (not shown) to allow water to flush from a lower barrel (not shown) of a hydrant body 115 into an upper barrel 118 of the hydrant body 115. To do this, an operating nut 120 is rotated thereby causing actuation of the stem 110. The operating nut 120 includes an interface portion 122 and a body portion 124. The body portion 124 includes a cavity 126, which includes internal threading 128. The internal threading 128 interacts with a plunger assembly 130. The plunger assembly 130 includes a threaded actuator 132 sheathing a piston 134. The threaded actuator 132 is not mechanically coupled to the piston 134 but instead is allowed to move freely up and down in the current view. The threaded actuator defines a square bore 133 and has a contact end 131. The square bore 133 is square in cross-section. The piston 134 includes an upper portion 136 and a lower portion 138. The lower portion 138 defines a bore 139, which will be discussed later. Although only a cross-sectional view is shown, the upper portion 136 is square in cross-section so that the threaded actuator 132 does not rotate when the operating nut 120 rotates. Instead, the threaded actuator 132 translates downward in the current view thereby manually opening the fluid valve (not shown). A coupling countersink 111 is seen in the stem 110. The lower portion 138 fits into the coupling countersink 111 and is shown inserted therein. The stem 110 defines a bore 112. A coupling shear pin 142 is inserted through both the bore 112 and the bore 139 to couple the plunger assembly 130 with the stem 110.

The foregoing paragraphs describe a manual override system of the flushable hydrant 100 that allow the flushable hydrant 100 to be operated externally by an operator such as a fireman or technician. As such, the flushable hydrant 100 can be used in the same application as prior art fire hydrants. However, the flushable hydrant 100 is also operable by other means, as described below.

Coupled to the stem 110 is a top stop 144. The top stop 144 provides bracing for one end of a biasing element 146. In the current embodiment, the biasing element 146 is a helical spring, although it may be various types of biasing elements in various embodiments, including various types of springs, magnetic biasing, electromechanical biasing such as servo-motor-actuation, electromagnetic biasing such as solenoid-actuation, and gravitational biasing, among others. The biasing element 146 is braced on its other end to a bottom stop 148. Because the top stop 144 is coupled to the stem 110, the biasing element 146 biases the flushable hydrant 100 to the closed position, as shown in FIG. 2.

As can be seen, the flushable hydrant 100 includes a shroud 149. The shroud 149 of the current embodiment is made of steel that is 0.100 inches in thickness, although various materials and thicknesses may be used in various embodiments. The flushable hydrant 100 includes six compressed gas containers 150*a-f* (150*b, c, d, e* not shown). For example, the gas containers 150*a-f* may contain compressed air. In various embodiments, various numbers, shapes, and configurations of compressed gas containers 150 may be used. In one exemplary embodiment, the shroud 149 is used as a compressed gas container 150 such that compressed gas fills the entire volume encompassed by the shroud. Such a configuration would obviate the need for separate compressed gas containers 150. Other fluid media may be used in the system of the current embodiment aside from compressed gas. Compressed gas is intended solely as an exemplary embodiment. Additionally, myriad variations on the systems, methods, and apparatus of the current embodiment may be used in various embodiments, including variations that may obviate the need for a fluid system, in some embodiments.

Each compressed gas container 150*a-f* is designed to hold a predetermined volume of compressed gas at a predetermined pressure. All of the compressed gas containers 150*a-f* are in fluid communication with one another such that the compressed gas containers 150*a-f* act as a single container, although various embodiments may include various different configurations.

Fittings 152*a-f* provide a fluid communication route from each compressed gas container 150*a-f* to gas bores 154*a-f* in a hydrant seal plate 155, respectively. Each fitting 152*a-f* in the current embodiment is made of brass, although other materials or configurations may be used. Each gas bore 154*a-f* is in fluid communication with a vein 156*a-f*, respectively, which connects to an annulus groove 158. Because all of the veins 156*a-f* are in fluid communication with the same annulus groove 158, compressed gas may move between the compressed gas containers 150*a-f* to equalize pressure therein. Annular gaskets 162*a, b* are seen sealing the annulus groove 158.

A hold down assembly 160 includes a hold down nut 164 and a stem body 166. The hold down nut 164 is connected by threading 167 to threading 169 of the stem body 166. The hold down assembly 160 sandwiches a bonnet 170 of the flushable hydrant 100. The connection of the hold down assembly 160 and the bonnet 170 is sealed by a gasket 171.

The stem body 166 defines a bias cavity 168 inside which the previously-mentioned biasing element 146 is seated. The stem body 166 also defines a pressure cavity 175. Within the pressure cavity 175 is a piston assembly 180. The piston assembly 180 includes a piston plate 182, a washer 184, a washer stop 186, a cylinder body 188, a bottom plate 189, and a bottom plate stop 187. In some embodiments, the bottom plate 189 and cylinder body 188 may be one piece. Annular gaskets 191*a, b* and 192*a, b* seal the space between the piston plate 182 and the bottom plate 189. Piston gaskets 194*a, b* seal a chamber 199 defined within the space between the piston plate 182 and the stem body 166 on the opposing side of the piston plate 182 from the bottom plate 189. The chamber 199 as shown has no volume. When the piston plate 182 moves, the chamber 199 becomes larger. The purpose of the piston gaskets 194*a, b* will become apparent below with reference to FIG. 3.

A gas intake port 196 can also be seen connected to the top of compressed gas container 150*a*. The gas intake port 196 allows the compressed gas containers 150*a-f* to be filled with compressed gas.

Figure 3:
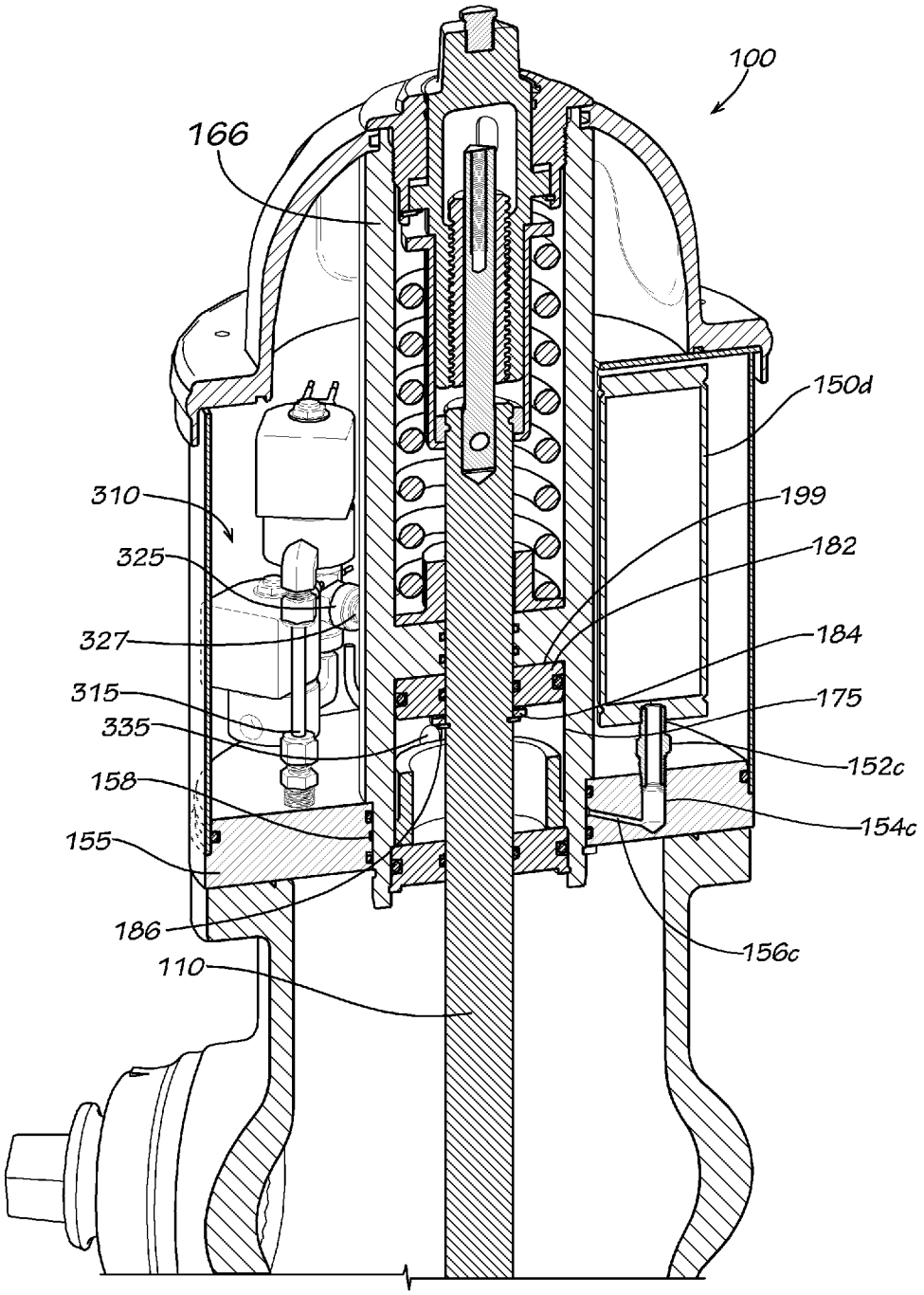
FIG. 3 is a cutaway view of the flushable hydrant of FIG. 2 taken along a different cutting plane from FIG. 2.

As seen in FIG. 3, the cutting plane of the flushable hydrant 100 is orthogonal to the cutting plane of FIG. 2. A pressure regulation assembly 310 can be seen in the current view. An annulus connection line 315 connects through a bore in the hydrant seal plate 155 to the annulus groove 158. As such, the annulus connection line 315 is in fluid communication with the annulus groove 158. The pressure regulation assembly 310 also includes a chamber line 325 that connects through a fitting 327 to the stem body 166. The stem body 166 includes a gas intake port 410 (not shown) leading to the chamber 199. A proximity sensor 335 can be seen in the pressure cavity 175. The pressure regulation assembly 310 also includes other features and apparatus (as will be described below) that allow the regulation of pressure through the pressure regulation assembly 310. The pressure regulation assembly 310 controls the amount of gas that flows from the annulus connection line 315 to the chamber line 325.

In operation, the flushable hydrant 100 can be actuated using the manual process described above. The flushable hydrant 100 can also be actuated by an actuation system. The actuation system may be connected to a remote communicator in various embodiments. One embodiment of an actuation system is described below, although one of skill in the art would understand that various elements may be altered or substituted in various modifications to the disclosure below without being considered outside the scope of the disclosure.

The stem 110 is capable of automatic actuation using the actuation system. The actuation system includes energy stored in the form of compressed gas, although various forms of stored energy may be used in various embodiments, including batteries, biasing elements such as springs and elastic, stored gravitational energy, mechanical batteries and flywheels, shape memory energy, and electromechanical storage, among other types of stored energy. Actuating the stem 110 using compressed gas is controlled by the pressure regulation assembly 310. The pressure regulation assembly 310 may include a wireless communication module or another communication module in various embodiments. The pressure regulation assembly 310 receives instructions to open the flushable hydrant 100. In response, the pressure regulation assembly 310, which is connected in fluid communication by the annulus connection line 315 to the annulus groove 158. The annulus groove 158 is connected to each vein 156*a-f*. Each vein 156*a-f* is connected to each gas bore 154*a-f*. Each gas bore 154*a-f* is connected to by each fitting 152*a-f* to each compressed gas container 150*a-f*. The chamber line 325 connects the pressure regulation assembly 310 in fluid communication to the chamber 199. Thus, the pressure regulation assembly 310 controls the release of compressed gas from the compressed gas containers 150*a-f* to the chamber 199.

In operation, the pressure regulation assembly 310 is opened to allow compressed gas to travel from the compressed gas containers 150*a-f* to the chamber 199. As pressure of the compressed gas in the compressed gas containers 150*a-f* is released into the chamber 199, the increased pressure in the chamber 199 is applied to the surface area of the piston plate 182. Pressure applied to an area creates a force on the piston plate 199 which is translated into the washer 184 and, thereby, into the washer stop 186. The force on the washer stop 186 is translated into the stem 110 resulting in a downward force on the stem 110.

As the compressed gas flowing from the compressed gas containers 150*a-f* to the chamber 199 increases, the downward force on the stem 110 increases. Eventually, the force on the stem 110 overcomes the closing pressure of the fluid valve (not shown), causing the valve to open. When the valve opens, water is allowed to flush into and through the flushable hydrant 110. As such, the actuation system operates as a biased translational system in the current embodiment. Various embodiments of biased translational systems may also be used in various embodiments.

Figure 4:
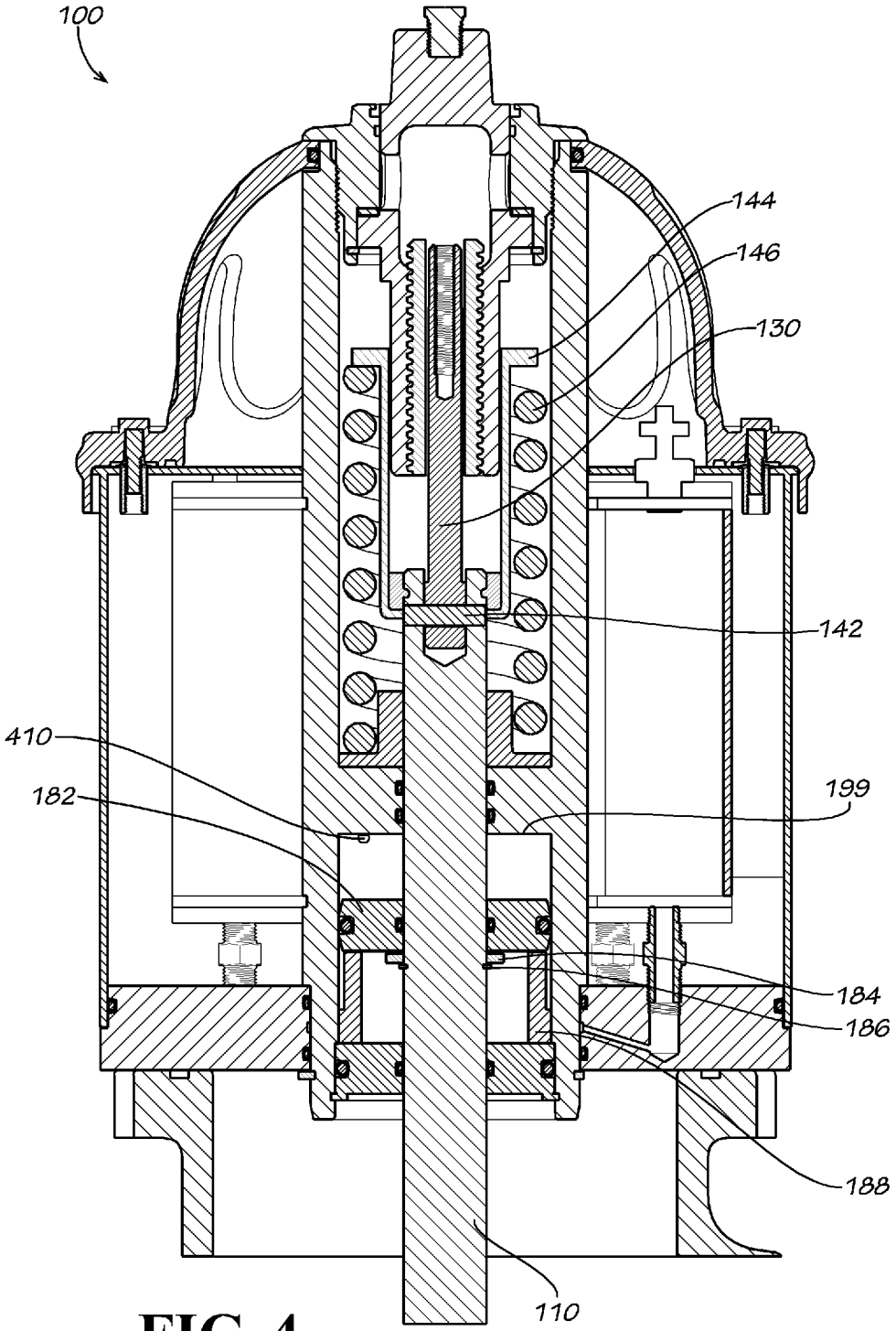
FIG. 4 is a cross-sectional view of the flushable hydrant of FIG. 2 in an actuated position.

To open the fluid valve, the stem 110 moves downward as shown in FIG. 4. In the current view, the gas intake port 410 can be seen in the chamber 199. The proximity sensor 355 (not shown) is covered by the piston plate 182 which causes the pressure regulation assembly 310 to close the gas pathway from the compressed gas containers 150*a-f* to the chamber 199.

As can be seen, the biasing element 146 has compressed, thereby storing energy. The top stop 144 has moved downward in the view because it is connected to the stem 110, as is the coupling shear pin 142, the piston plate 182, the washer 184, and the washer stop 186. In the current embodiment, all of these parts have moved until the piston plate 182 contacts the cylinder body 188 and the cylinder body 188 provides a mechanical stop. Other embodiments many include various configurations for stops. It should be noted that no other parts or subassemblies of the flushable hydrant 100 have moved in the current embodiment, although various configurations may be present in various embodiments.

Figure 5:
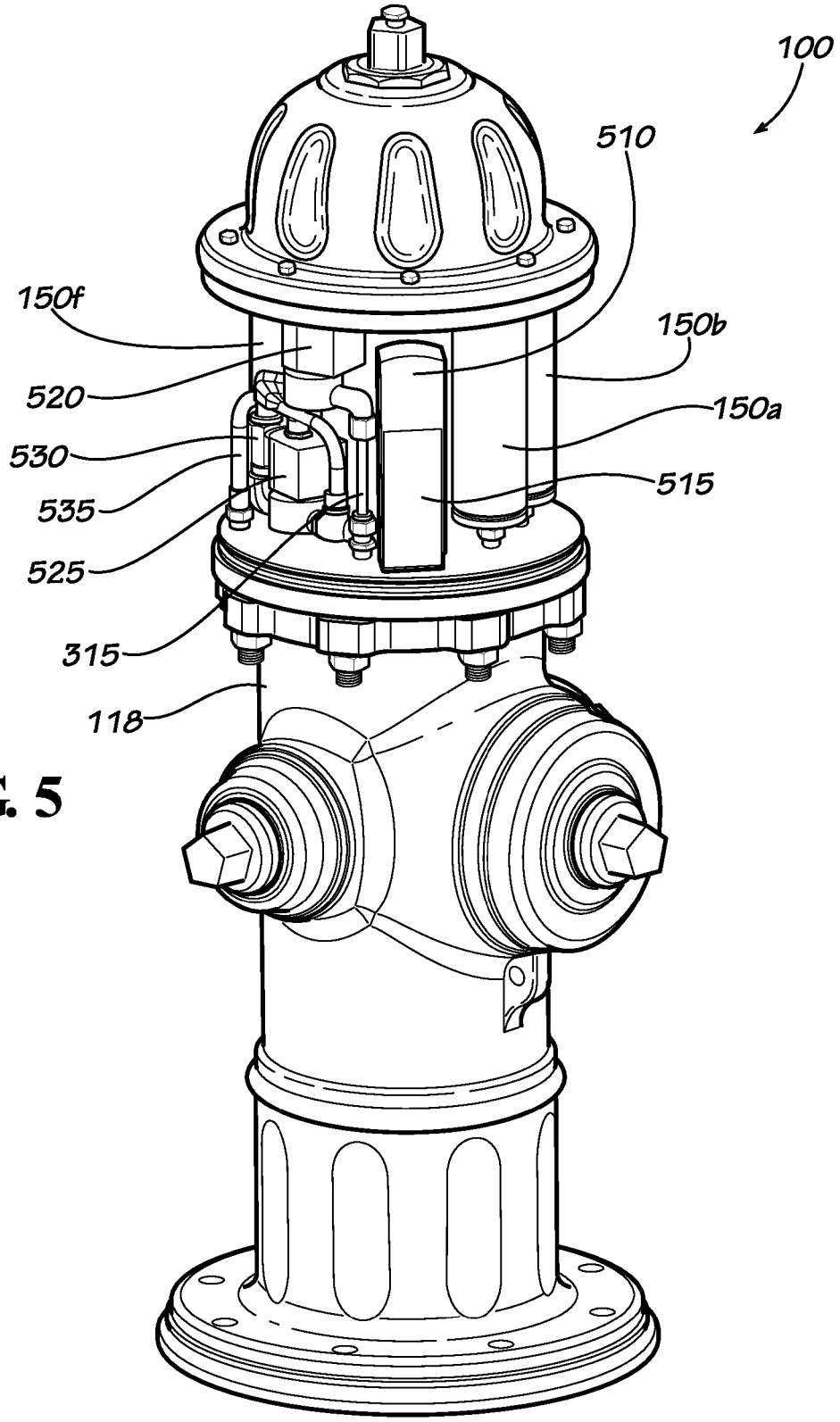
FIG. 5 is a perspective view of the flushable hydrant of FIG. 2 without a shroud.

FIG. 5 shows a perspective view of the flushable hydrant 100. Compressed gas containers 150*a, b, f* can be seen in the view (150*c, d, e* are hidden from view). A battery 510 is held in place by a battery bracket 515. A gas intake valve 520 and a gas discharge valve 525 can be seen. Although the gas intake valve 520 and the gas discharge valve 525 are used in the current embodiment, various types of pressure regulation mechanisms, systems, and methods may be used in various embodiments. Between the gas intake valve 520 and the gas discharge valve 525 is a tee joint 530. The tee joint 530 is connected on one side to the gas intake valve 520, on one side to the gas discharge valve 525, and on one side to the chamber line 325 (shown in FIG. 3). The gas intake valve 520 and gas discharge valve 525 control the system.

Before any flushing takes place, pressure in the compressed gas containers 150*a-f* is at its highest, and there is no pressurization in the chamber 199. To open the fluid valve (not shown), as previously described, the gas discharge valve 525 closes and the gas intake valve 520 opens. As such, the pressure in the chamber 199 increases until the force exerted on the piston plate 182 overcomes the closing pressure of the fluid valve (not shown) at which point the fluid valve opens. As previously described, pressure in the compressed gas containers 150*a-f* is much greater than necessary to open the fluid valve (not shown). As such, when the proximity sensor 355 recognizes that the piston plate 182 has moved to open the fluid valve (not shown), the gas intake valve 520 closes. This feature helps preserve compressed gas (e.g., compressed air) in the compressed gas containers 150*a-f* because it may not be necessary for the pressure to equalize fully from the compressed gas containers 150*a-f* to the chamber 199 in order to open the fluid valve (not shown). Preserving compressed gas allows more flushing cycles to occur without refilling the compressed gas containers 150*a-f*. In some embodiments, the gas intake valve 520 and gas discharge valve 525 may each be configured to include a solenoid, which physically opens or closes a pneumatic valve in response to electrical input. In addition to a solenoid, the gate intake valve 520 and gas discharge valve 525 may also include a gas intake port (e.g., gas intake port 196) and a gas discharge port, respectively. For example, the gas intake port may lead into the chamber 199 and the gas discharge port may lead into the surrounding environment.

Once water flushes into the flushable hydrant 100, the pressure inside the upper barrel 118 equalizes with the system pressure. Thus, water in the system provides no closing pressure on the fluid valve (not shown). Instead, closing pressure on the fluid valve is provided by the biasing element 146, which becomes compressed due to the force on the piston plate 182.

When it is desired to close the fluid valve, the gas discharge valve 525 is opened while the gas intake valve 520 remains closed. The exhaust line 535 vents to outside air. Without closed pressure in the chamber 199, compressed gas is allowed to flow through an exhaust line 535 that is connected to the gas discharge valve 525. The pressure in the chamber 199 is released, thereby relieving the downward force on the piston plate 182. The release of the downward force allows the biasing element 146 to lift the stem 110 and, thereby, to close the fluid valve.

Figure 6:
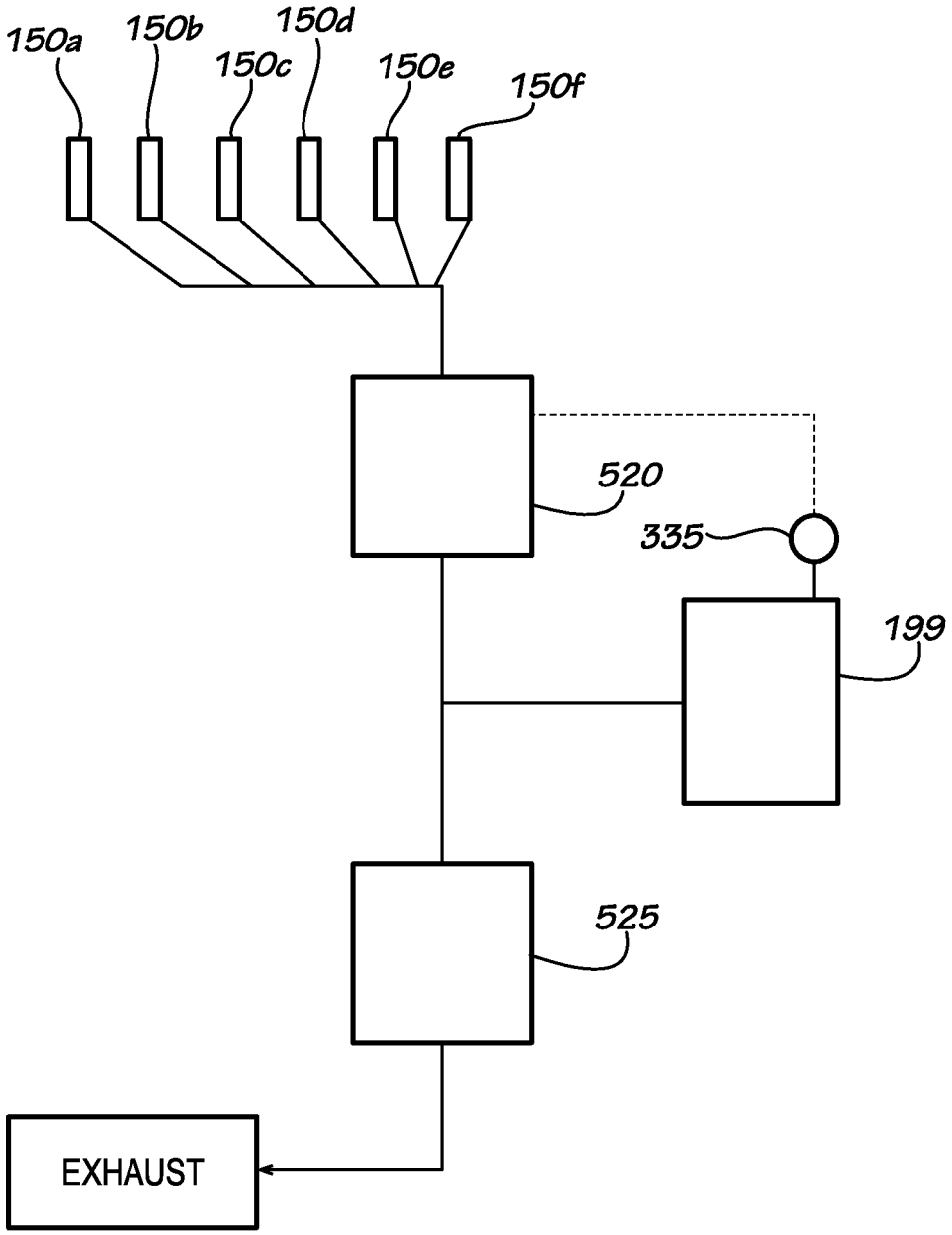
FIG. 6 is a schematic representation of a compressed gas system of the flushable hydrant of FIG. 2.

FIG. 6 displays a schematic representation of the compressed gas system of the flushable hydrant 100. In the current embodiment, the compressed gas containers 150*a-f* are in fluid communication with each other and are connected to the gas intake valve 520. The gas intake valve 520 maintains any compressed gas in the compressed gas containers 150*a-f* until operation of the flushable hydrant 100 is desired as described above. When the flushable hydrant 100 is operated, the gas discharge valve 525 closes and the gas intake valve 520 opens. This allows compressed gas to flow into the chamber 199. When the proximity sensor 335 is activated as described above, the proximity sensor 335 sends a signal to the gas intake valve 520 to close, cutting the flow of compressed gas from the compressed gas containers 150*a-f* to the chamber 199. When it is desired to return the flushable hydrant 100 to resting state, the gas discharge valve 525 is opened, allowing compressed gas in the chamber 199 to escape and to exhaust.

Figure 7:
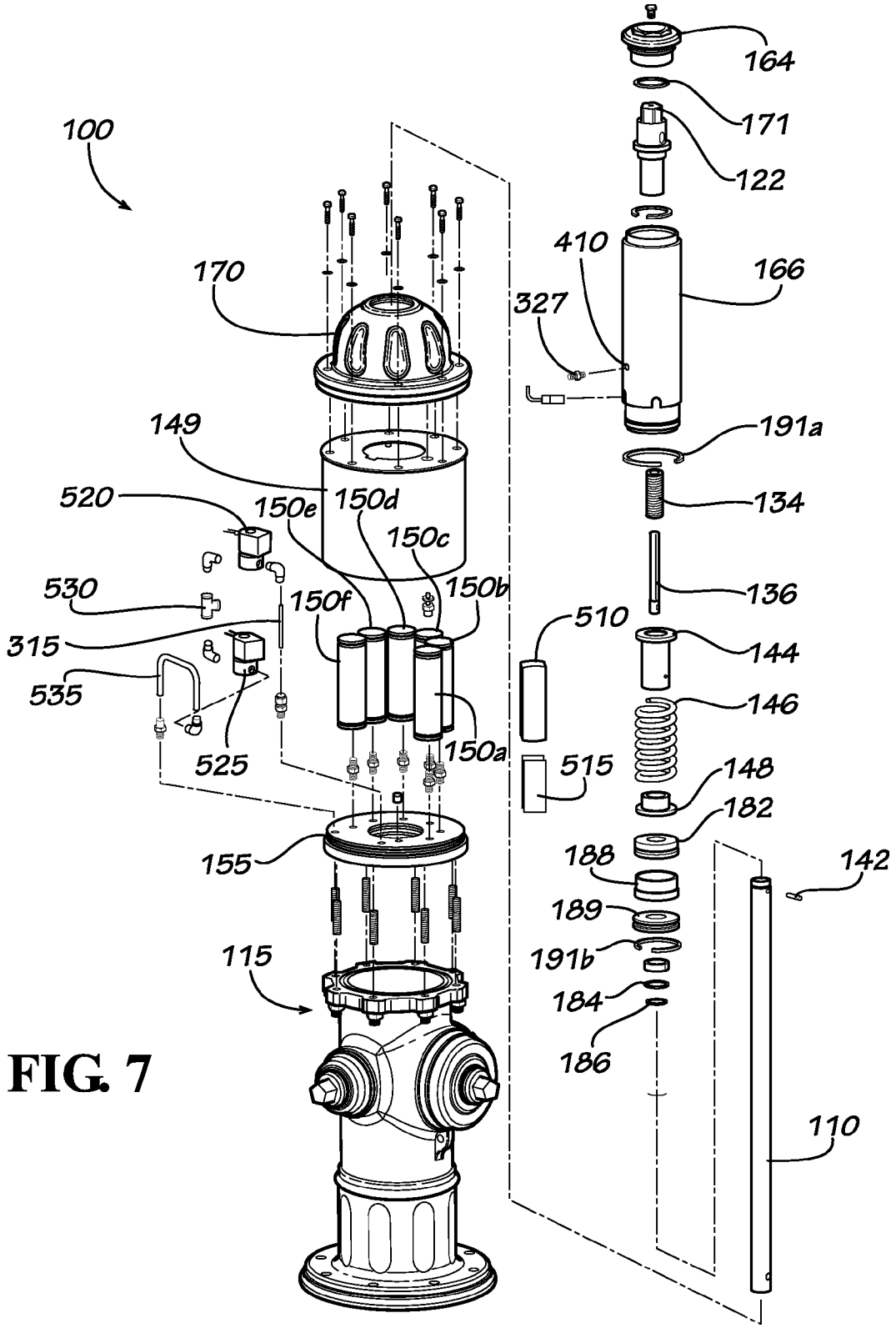
FIG. 7 is an exploded perspective view of the flushable hydrant of FIG. 2.

An exploded view of the flushable hydrant 100 is seen in FIG. 7. In addition to features of the current embodiment that have already been mentioned, the exploded view of the flushable hydrant 100 also shows bolts holding the flushable hydrant 100 together, among other various features.

Figure 8:
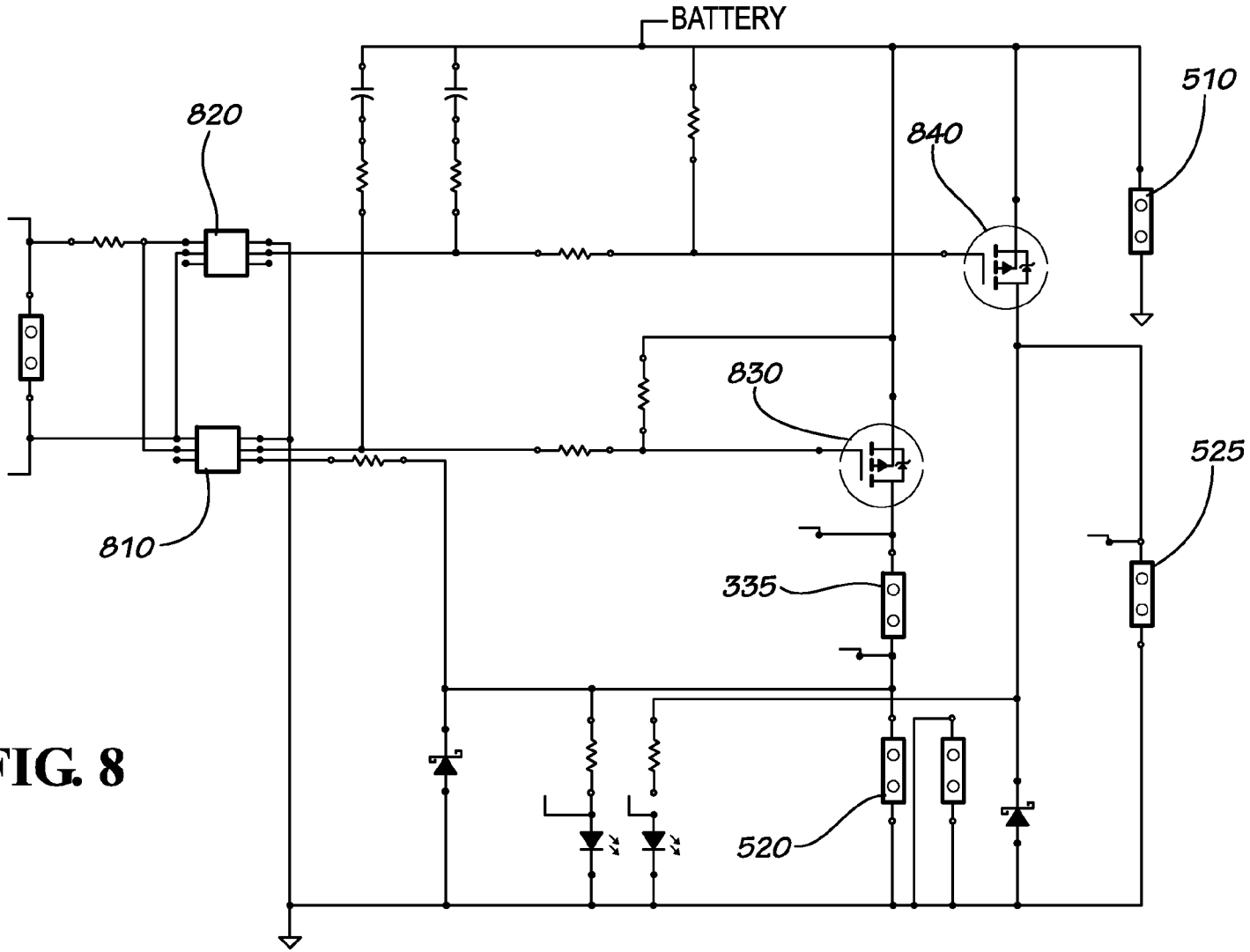
FIG. 8 is an electrical schematic of the flushable hydrant of FIG. 2.

An electrical schematic can be seen in FIG. 8. The electrical schematic of FIG. 8 is but one method of compiling the circuitry to achieve the desired result, and one of skill in the art would understand that variations to such an arrangement may be possible in various embodiments.

In the current embodiment, each of the gas intake valve 520 and the gas discharge valve 525 are operational as electrical latching solenoids, although various types of pressure regulation mechanisms may be present in various embodiments. The gas intake valve 520 and the gas discharge valve 525 may be normally closed in some embodiments. In various embodiments, the gas discharge valve 525 may be normally open.

A first isolator 810 and second isolator 820 provide circuit isolation depending on the direction of current into the system. When current flows in one direction, one circuit is activated; when current flows in the opposite direction, another circuit is activated. As such, the electrical configuration of the current embodiment does not operate both the gas intake valve 520 and the gas discharge valve 525 at the same time, although one of skill in the art would understand that a simple modification would allow such a configuration.

A switch 830 is controlled by the first isolator 810. Switches 830, 840 are electrical switches in the current embodiment, such as transistors. Various embodiments may include variations of switches, including both electrical and mechanical switches. When it is desired to open the gas intake valve 520, current flows through the first isolator 810 and closes the switch 830, allowing current to flow across the switch 830. The current is allowed to flow through the proximity sensor 335 when the proximity sensor 335 is not activated. In other words, the proximity sensor 335 is normally shorted. The flowing current activates the gas intake valve 520, causing it to open, as described above. The first isolator 810 receives a feedback from the circuit to remain on so long as the proximity sensor 335 is shorted. This action provides the electrical latching of the solenoid in the gas intake valve 520.

As described above, the opening of the gas intake valve 520 causes the piston plate 182 to travel in front of the proximity sensor 335. When this occurs, the proximity sensor 335 is activated and provides an open in the circuitry. The feedback to the first isolator 810 is cut, and the switch 830 opens, deactivating the gas intake valve 520 and returning the solenoid in the gas intake valve 520 to its normally closed position.

When it is desired to open the gas discharge valve 525, current flows the opposite direction and activates the second isolator 820, thereby closing a switch 840 and allowing current to flow to the gas discharge valve 525. Because no proximity sensor is used with the gas discharge valve 525, the system simply opens the gas discharge valve 525 for a preset duration using an RC (resistor-capacitor) configuration. In the current embodiment, the duration that the gas discharge valve 525 is opened is a few seconds, although various time durations may be used in various embodiments. Once the timing of the RC current has expired, the switch 840 opens, stopping current flow to the gas discharge valve 525. When power to the solenoid of the gas discharge valve 525 is stopped, the gas discharge valve 525 returns to its normally closed position. Various electronic circuits that are shown but not described would be understood by one of skill in the art.

Figure 9:
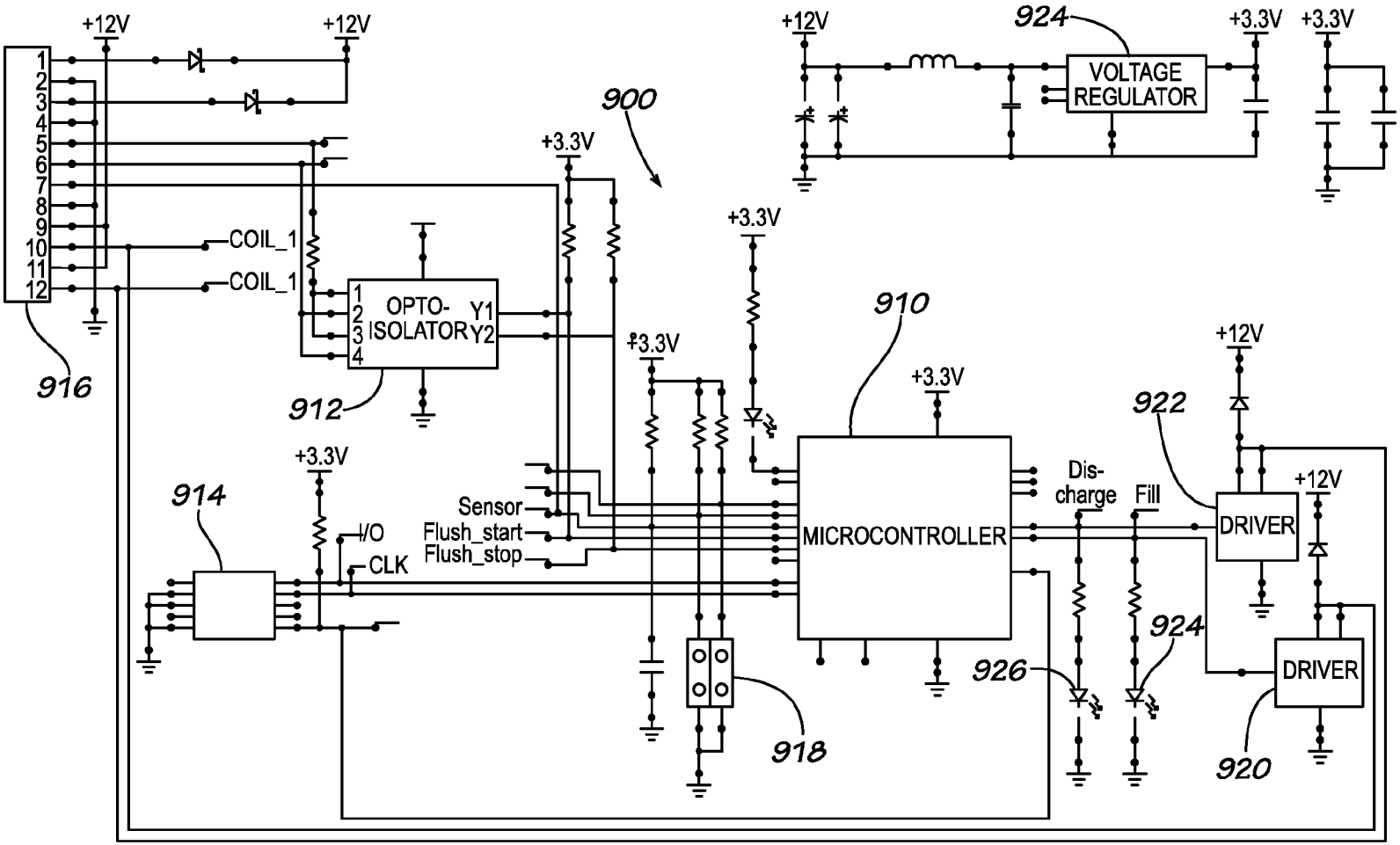
FIG. 9 is an electrical schematic of one embodiment of a flushable hydrant.

FIG. 9 illustrates a schematic circuit diagram of a control circuit 900 according to various implementations of the present disclosure. The control circuit 900 is considered to be an alternative to the circuit of FIG. 8. One of ordinary skill in the art may understand that certain modifications can be made to the control circuit 900 without departing from the spirit and scope of the present disclosure. As arranged in FIG. 9, the control circuit 900 may be configured to control the operations of the flushable hydrant 100. The control circuit 900 may be contained on a printed circuit board or other suitable board. The control circuit 900 is configured to be connected to a communication device (e.g., a communication circuit board) that can receive a wireless signal from a wireless network, wherein the wireless signal includes instructions to start a flushing cycle or stop a flushing cycle. The control circuit 900 is also configured to be connected to the solenoids of the gas intake valve 520 and gas discharge valve 525 and to the proximity sensor 335.

In response to the flushing instruction signals from the communication device, the control circuit 900 controls the air pressure in the chamber 199 by switching the solenoid valves. According to some embodiments, the control circuit 900 contains a failsafe arrangement such that if power to the control circuit 900 is lost, the solenoid valves return to their steady state or rest conditions. For example, at rest, the gas discharge valve 525 may remain in an open state to release any residual gas pressure and the gas intake valve 520 may remain in a closed state to preserve pressurized gas in the gas container 150.

The package components of the control circuit 900 shown in the circuit diagram of FIG. 9 include a microcontroller 910, an opto-isolator 912, a debug device 914, an external connector 916, a shorting jumper 918, a first driver 920, a second driver 922, and a voltage regulator 924. The circuit also includes resistors, capacitors, inductors, diodes, LEDs, and other electrical components used in a manner that will be understood by one of skill in the art.

The voltage regulator 924 is connected to a 12-volt power supply (e.g., a battery or battery pack) and regulates a 3.3-volt power signal for operating the digital components of the circuit. The shorting jumper 918 may be configured to close a break in the circuit. The debug device 914 (e.g., JTAG or other suitable debugger) may include one or more plugs, solder joints, pads, etc. to enable the debugging of the microcontroller 910 or joints. The debug device 914 includes at least an I/O line and a clock line connected to the microcontroller 910. When the control circuit 900 is in a sleep state, the shorting jumper 918 is able to force the control circuit 900 into an awake state to enable a technician to debug the device if needed.

The external connector 916 includes 12 pins, labeled 1-12. Pins 1-8 are configured for receiving inputs from external sources and pins 9-12 are configured for providing outputs to the external sources. Pins 1 and 3 are connected to the positive terminal of one or two 12-volt power supplies (e.g., from batteries or other external sources) for supplying 12 volts to the control circuit 900 where needed. Pins 2, 4, and 8 are connected to the negative or ground terminal of the 12-volt power supply and may be grounded. Pins 5 and 6 are connected to the communication device, which may be housed on the flushing hydrant 100. Pin 7 is connected to a sensor. Pins 9 and 11 are supply voltage outputs for the solenoid valves. Pin 10 is connected to a first solenoid valve configured to control air intake and pin 12 is connected to a second solenoid valve configured to control air discharge. Pins 5, 6, and 7 are primarily input pins for receiving control signals and sensor signals. Pins 10 and 12 are primarily output pins for providing control signals to the first and second solenoid valves.

The input pins 5 and 6 may be configured to receive bi-directional control signals from the communication device or other external control circuit. The external control circuit may include an H-bridge or other type of device for providing bi-directional controls. The external control circuit is configured to provide a current in one direction as a request to start a new flush cycle and provide a current in the other direction as a request to stop the flush cycle. For example, a positive current from pin 5 to pin 6 (phase_A to phase_B) indicates a flush start request, whereas a negative current from pin 5 to pin 6 (phase_A to phase_B) may indicate a flush stop request.

The opto-isolator 912 includes input pins 1-4 and digital output pins Y1 and Y2. When there is a positive voltage between pins 1 and 2, the opto-isolator 912 responds by providing a digital output along pin Y1, which is referred to herein as a "flush_start" signal. The flush_start signal is sent to input pin 7 of the microcontroller 910. Also, when there is a negative voltage between pins 3 and 4, the opto-isolator 912 responds by providing a digital output along pin Y2, which is referred to herein as a "flush_stop" signal. The flush_stop signal is sent to input pin 8 of the microcontroller 910.

As mentioned above, pin 7 of the external connector 916 is connected to receive an input from a sensor. The sensor may be a proximity sensor (e.g., proximity sensor 335) or other type of sensor for detecting the presence of an object. In this case, the sensor detects when the piston plate 182 has been forced down to a certain position to such an extent that the fluid valve 14 opens. In response to sensing the presence of the piston plate 182, the sensor sends a positive signal, which is received on pin 7 of the external connector 916 and provided to pin 6 of the microcontroller 910.

Therefore, the microcontroller 910 is configured to receive input signals from the proximity sensor and also receive input signals for flush_start and flush_stop. In response to these inputs, the microcontroller 910 is configured to control the various states of the flushing hydrant 100, as explained in more detail below with respect to the state diagram of FIG. 11. The microcontroller 910 controls the states of the flushing hydrant 100 by providing certain output signals as explained in more detail below with respect to the timing diagram of FIG. 12.

The microcontroller 910 may include a microprocessor or other suitable type of processing device. The microcontroller 910 may be configured to monitor various conditions and provide logic and timing functionality. Based on various conditions, logic, and timing parameters, the microcontroller 910 may be configured to control the drivers 920 and 922.

For example, the microcontroller 910 provides an output to the first driver 920, which controls the gas intake valve 520. The microcontroller 910 also provides an output to the second driver 922, which controls the gas discharge valve 525. Signals sent to the drivers 920 and 922 may also illuminate LEDs 924 and 926, respectively, which may be used for indicating the status of the drivers (and solenoids) to a person near the flushing hydrant 100. When a positive signal is received from the microcontroller 910, the first driver 920, in some embodiments, may provide a 12-volt signal to pin 10 of external connector 916 leading to the solenoid of the gas intake valve 520 Likewise, when a positive signal is received from the microcontroller 910, the second driver 922, in some embodiments, may provide a 12-volt signal to pin 12 of external connector 916 leading to the solenoid of the gas discharge valve 525. Thus, the solenoids may be powered by the 12-volt signals. In other embodiments, the drivers 920 and 922 may be configured to create a short to ground in order to activate the solenoids.

The control circuit 900 may include the following specifications. The battery power input and auxiliary power input are nominally 12 volts, but may range from about 11-14 volts. The quiescent/standby current is nominally 25 μA, but may have a maximum of 35 μA. The operating current is 5 mA (nominal) and 15 mA (maximum). The solenoid coil current is 0.80 amps (nominal) and 1.00 amps (max). The solenoid coil equivalent circuit has an impedance of 13 ohms +55 mH (nominal) and 13 ohms +70 mH. The solenoid driver avalanche protection is 0.050 joules (nominal) and may range from 0.030 to 0.100 joules. The solenoid driver has short circuit protection. The operating temperature may range from −30 degrees Celsius to 70 degrees Celsius.

Figure 10:
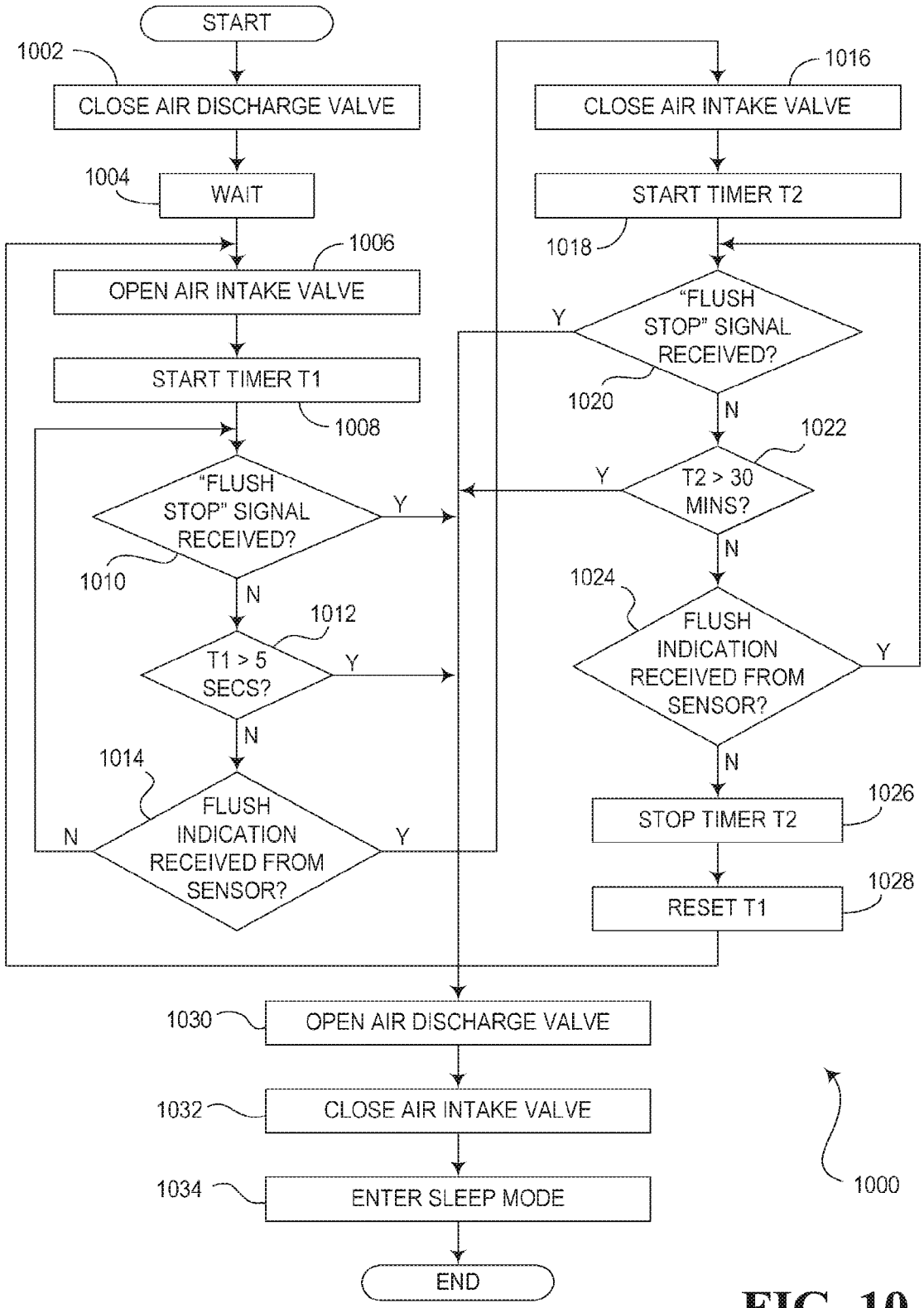
FIG. 10 is a flow diagram showing an embodiment of a method for operating the flushable hydrant of FIG. 9.

FIG. 10 illustrates a method 1000 for operating the flushable hydrant 100 according to various embodiments of the present disclosure. In some embodiments, the method 1000 may be executed by the microcontroller 910 or by some or all of the components of the control circuit 900. The method 1000 starts when the "flush_start" signal is received. As shown, the method includes closing an air discharge valve (e.g., gas discharge valve 525) as described in block 1002 so that any air pressure applied to the chamber (e.g., chamber 199) will not escape. Then, the method waits for a certain delay time (step 1004). After a short wait (e.g., about one second), the method includes opening an air intake valve (e.g., gas intake valve 520) as indicated in block 1006. Opening the air intake valve allows air from the compressed air tank(s) (e.g., gas containers 150) to enter the chamber 199 and build up pressure. When the air pressure is great enough, the pressure will force the piston (e.g., piston plate 182) in a certain direction. When the air intake valve is opened, the method further includes starting a first timer, as indicated in block 1008. The timer T1 is used to monitor the time that it takes the air pressure to force the piston into a position where the fluid valve is opened to allow the hydrant to be flushed.

The method of FIG. 10 also includes determining whether or not a "flush_stop" signal is received (step 1010). If such a signal is received, the method branches off to block 1030 to begin a shutdown routine. If no "flush_stop" signal is received, the method proceeds to decision block 1012, which determines whether the timer T1 is greater than five seconds. Thus, if the compressed air tanks do not provide adequate pressure to force the piston so as to open the fluid valve within the designated time, then the pressurization stage is aborted and the method skips to block 1030 to begin the shutdown routine. If five seconds has not been reached, the method proceeds to decision block 1014. As indicated by this block, the method includes the step of determining whether or not some type of flush indication is received from the sensor (e.g., proximity sensor 335). For example, if the sensor detects that the position of the piston has been moved to such a location that the fluid valve is opened, then it is known that the air pressurization routine has successfully pressurized the chamber 199 so as to open the fluid valve. As such, the method proceeds from the air pressurization stage and moves to a flush stage, which starts, for example, with block 1016. However, if no flush indication is receives at step 1014, the method loops back to decision block 1010.

As indicated in block 1016, the method includes the process of closing the air intake valve. This valve is closed because at this point the chamber is adequately pressurized and more pressurized air is not needed. As indicated in block 1018, a second timer T2 is started. This timer records the time that the hydrant is maintained in a flushing condition. The method then proceeds to decision block 1020, which suggests that a determination is made as to whether or not a "flush_stop" signal is received. If so, the method skip ahead to block 1030 to begin the shutdown routine. If no such signal is received, the method goes to decision block 1022 and it is determined whether the second timer is greater than a predetermined flush time. In this example, the predetermined flush time is 30 minutes. If the hydrant has been flushing for at least 30 minutes, then the method jumps to block 1030 to begin the shutdown routine. If less than 30 minutes, the method proceeds to decision block 1024. At this point, it is determined whether or not a flush indication is still being received from the sensor. If the sensor is still indicating that the hydrant is in the flush mode, the method returns back to decision block 1020 to continuing check the three conditions described in blocks 1020, 1022, and 1024. If the sensor no longer indicates that the hydrant is flushing in step 1024, the method goes to block 1026.

Block 1026 indicates that the second timer T2 is stopped. In some embodiments, the T2 time may later be resumed from where it left off after the flushing begins again. In this way, the total flushing time (even if interrupted) can be monitored. In various embodiments, the T2 time may be reset so that the flushing time is only for a continuous interrupted amount of time. In step 1028, the first timer T1 is reset and the method returns back to block 1006 to begin the pressurization stage again. For example, if it is determined that the hydrant is not flushing, the air pressure should be re-applied to open up the fluid valve again to continue the flushing cycle.

The shutdown routine of the method begins with block 1030. The method opens the air discharge valve to release the air pressure in the chamber, which allows a biasing member 146 to force the piston back to its rest state and closes the fluid valve. Step 1032 includes closing the air intake valve, if it has not already been closed in a previous step. Also, the method includes entering a sleep mode (step 1034) and ending the flush routine.

Figure 11:
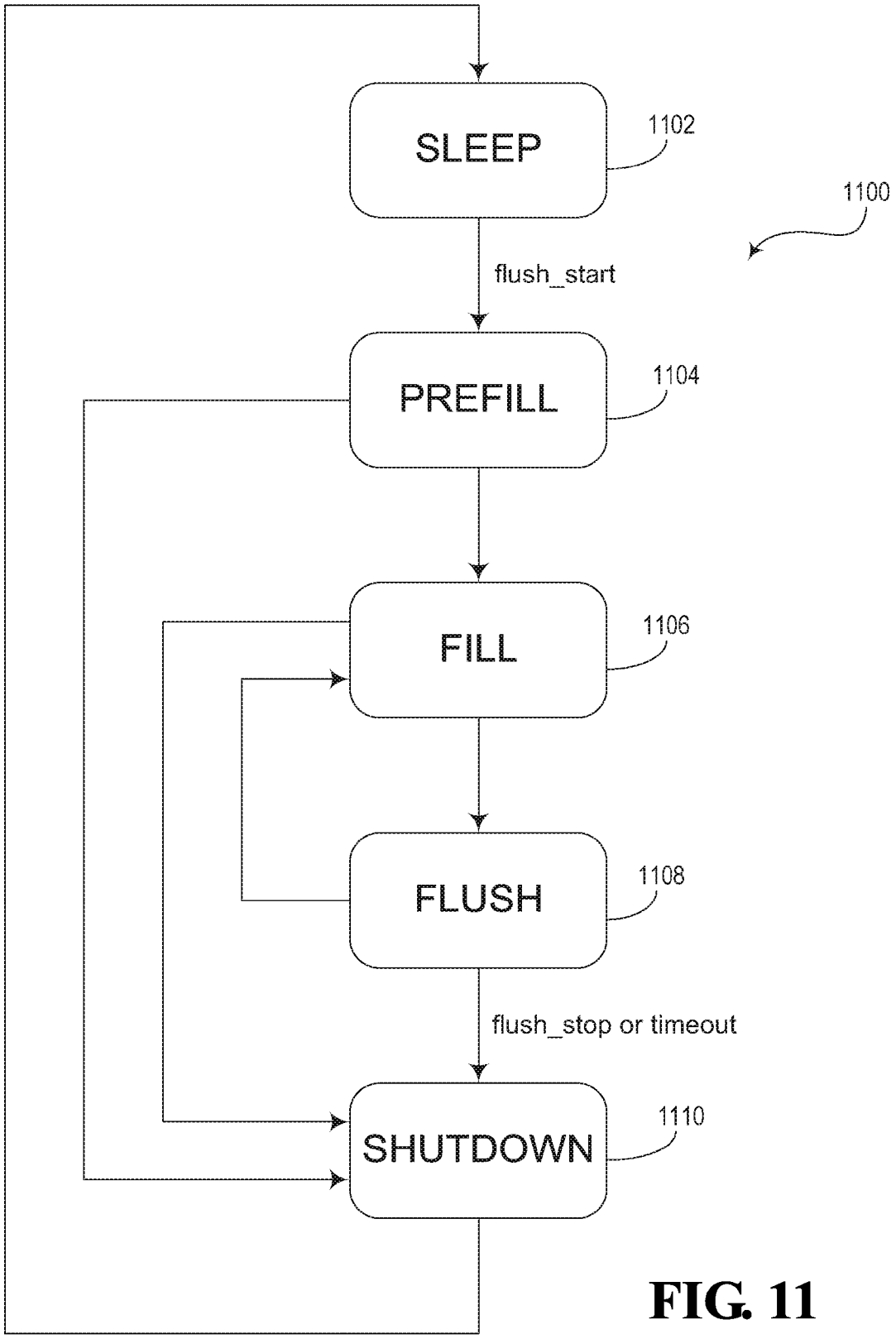
FIG. 11 is a state diagram showing an embodiment of the various states when the flushable hydrant of FIG. 9 is operated.

FIG. 11 illustrates a state diagram 1100 indicating the states of operation for the flush system. In some embodiments, the states may be controlled by the microcontroller 910 shown in FIG. 9. As shown, the state diagram 1100 includes a first state represented as a "sleep" state 1102 when the electrical components are in a low-power mode for conserving power. For example, the sleep state 1102 may consume about 25 to 35 μA from the +12V power source. In the sleep state 1102, the solenoid for the gas discharge valve 525 may maintain the valve in an open or "venting" condition such that air in the chamber is exposed to ambient air and the pressure in the chamber is equalized with the environment. The solenoid for the gas intake valve 520 may maintain the valve in a closed state such that the pressurized air in the tanks is conserved in the tanks. The system remains in the sleep state 1102 until a flush_start signal is received, which wakes up the system to begin a new flush cycle. The system may also awaken from a forced_wake signal.

When awakened, the system moves to a "prefill" state 1104. The prefill state 1104 precedes a state when the chamber is actually filled with pressurized air. In the prefill state 1104, the normally-open gas discharge valve 525 is closed, thereby pneumatically sealing the chamber to enable pressurization. The system remains in the prefill state 1104 for a short time (e.g., about one second) to allow the gas discharge valve 525 to close for sealing the chamber. Then the system moves to a "fill" state 1106.

The fill state 1106 includes opening the normally-closed gas intake valve 520. With the chamber 199 sealed, pressurized air from the gas cylinders 150A-F may enter the chamber to build the air pressure. In the fill state 1106, the sensor 335 detects when the piston 180 has been moved to such a position that the fluid valve is opened. Before the piston reaches this point, indicating that the air pressure has not yet forced the piston far enough, the air pressure continues to build in the chamber. The system also determines if the sensor does not assert within a certain amount of time that would normally be needed for the intake air to pressurize the chamber. For example, the pressurization time may be about five seconds. Not being able to pressurize within this period may be an indication of a problem and the system may move from the fill state 1106 to the "shutdown" state 1110 as described below. Otherwise, if the sensor senses the presence of the piston in a position that indicates that the fluid valve is open and the hydrant is flushing, then the air intake valve may be closed and the system moves to the "flush" state 1108. The flush state 1108 may also be referred to as an "open" state to indicate that the fluid valve is open and the system is flushing.

When it is determined that flushing has begun and the air intake has been closed, no more air is needed for pressurization. Even with the air intake closed, the pressurized air in the chamber remains pressurized (unless there is a leak in the system). The constant pressure keeps the piston in the down position thereby keeping the fluid valve open. The hydrant continues to flush during the flush state 1108. The system may leave the flush state 1108 in response to multiple different conditions. If a "flush_stop" signal is received, indicating that the flushing cycle is to stop, then the system moves to the shutdown state 1110. In some embodiments, if a certain amount of time from the start of the flush cycle elapses (i.e., times out), then the flush cycle 1108 has successfully completed and the system moves to the shutdown state 1110. According to additional embodiments, if the sensor determines that the piston has not remained in the down position to thereby keep the fluid valve open, the system moves from the flush state 1108 back to the fill state 1106 to allow more pressurized air to fill the chamber. Once sufficient pressure has been added in the fill state 1106 to resume flushing, as indicated by the sensor 335, the system may return back to the flush state 1108.

The shutdown state 1110 may be entered when a flush_stop signal is received during the prefill 1104, fill 1106, or flush 1108 states. The shutdown state 1110 may also be entered when the flush cycle has completed in the flush state 1108 in response to a flush_stop signal or timeout. During the shutdown state 1110, the air discharge valve is opened to release pressure from the chamber. Also, the air intake valve is closed if it has not already been closed during another state. When the fluid valve and air valves are returned to their rest conditions, the system returns to its sleep state 1102 and waits for the next flush cycle to begin.

Figure 12A:
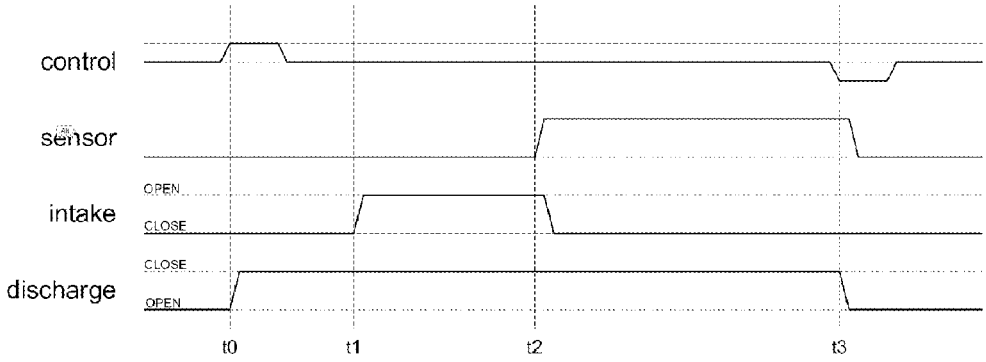
FIGS. 12A-12C are timing diagrams showing examples of timing characteristics of the operation of the flushable hydrant of FIG. 9.
Figure 12B:
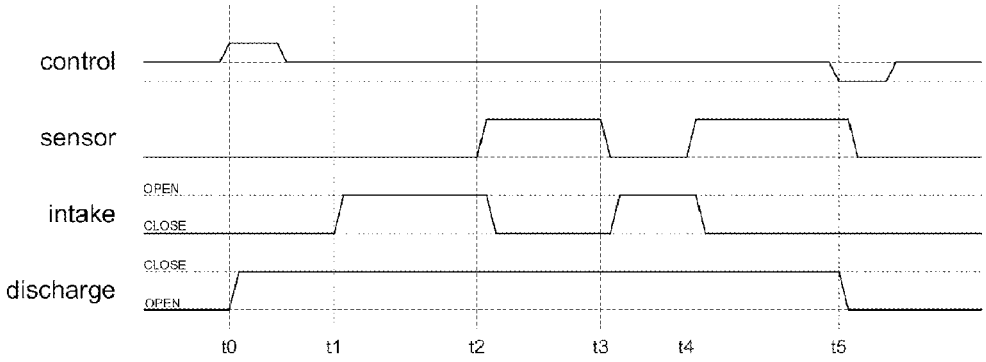
Figure 12C:
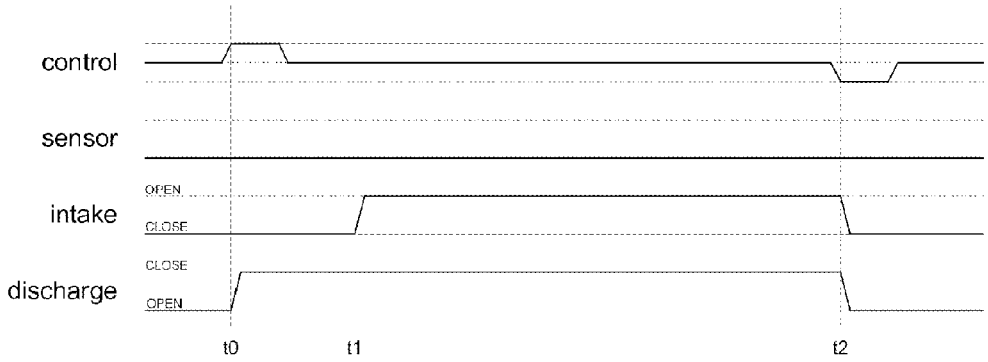

FIGS. 12A-C are timing diagrams of the flushing system according to various implementations of the present disclosure. The timing diagrams show the timing signals for a controller (e.g., the control circuit 900 or microcontroller 910), a sensor (e.g., proximity sensor 335), an intake solenoid (e.g., the solenoid associated with gas intake valve 520), and a discharge solenoid (e.g., the solenoid associated with the gas discharge valve 525). These four timing signals are labeled on the left side of the diagram as "control," "sensor," "intake," and "discharge," respectively. According to some embodiments, the intake solenoid keeps the gas intake valve in a closed position when at rest and the discharge solenoid keeps the gas discharge valve in an opened position when at rest.

FIG. 12A shows the timing signals for control, sensor, intake, and discharge when the system is operating in a normal manner, according to some embodiments. The first time instance may be the initiation of the flush cycle in response to a flush_start signal. The controller asserts a positive signal to indicate the start. Immediately thereafter, the discharge solenoid asserts a positive signal (e.g., positive voltage signal) to close the normally-open air discharge valve. The air discharge valve may remain closed during the duration of the flush cycle. A predetermined time after this first time instance, the intake solenoid asserts a positive signal (e.g., positive voltage signal) to open the normally-closed air intake valve, as indicated by the second time instance. The air intake valve remains open for enough time until the air pressure sufficiently pressurizes the chamber.

The third time instance represents a time (after the air intake valve has been opened) when the sensor detects the presence of the piston in the proper position for flushing. The sensor asserts a positive signal and in response the intake solenoid de-asserts the signal to close the air intake valve. Since FIG. 12A represents the system operating normally, the sensor signal remain high for the remaining duration of the flush cycle, indicating that the piston is still in the flushing position. The system remains in this condition for the duration of time needed to flush the hydrant (e.g., 30 minutes) or until a flush_stop signal is received.

When the flushing time has expired or the flush_stop signal is received, the controller provides a negative signal, which indicates the end of the flush cycle. Immediately thereafter, the discharge solenoid is de-asserted, thereby opening the air discharge valve and releasing the pressure, causing the piston to return to its stable state and out of range of the proximity sensor. The sensor senses this change and outputs a low signal to indicate that the flushing cycle has ended. It may be noted that the air intake valve had been closed prior to the end of the flush cycle and does not need to be closed at this time.

FIG. 12B shows a situation where a certain amount of leakage from the pressure chamber may occur. In this case, the air intake valve is opened and then re-opened in order to maintain adequate pressure. The first three time instances are the same as described above with respect to FIG. 12A. At the fourth time instance shown in FIG. 12B, the sensor detects that the piston has moved out of the flushing position towards its normal rest state, which indicates that the fluid valve is closing or closed and the air pressure inside the chamber is losing pressure. When the sensor de-asserts a low signal, the air intake solenoid valve responds by opening the valve again to apply more pressure. At the next time instance, the sensor detects the piston in the flush position again and the air intake valve can be closed again. At the end of the flush cycle (e.g., when flushing time period has expired or when a flush_stop signal is received), the air discharge valve is opened and the sensor again indicates closure of the fluid valve.

FIG. 12C shows a situation when the air pressure from the air tanks is not enough to properly pressurize the chamber in the allotted amount of time (e.g., five seconds). The first two time instances in FIG. 12C are the same as the previous two figures. However, it should be noted that in this situation the sensor never detects the presence of the piston and never asserts a high signal. After timeout, the controller sends a flush_stop signal. In response to the flush_stop signal, the discharge solenoid opens the air discharge valve as usual and the intake solenoid closes the air intake valve.

Figure 13:
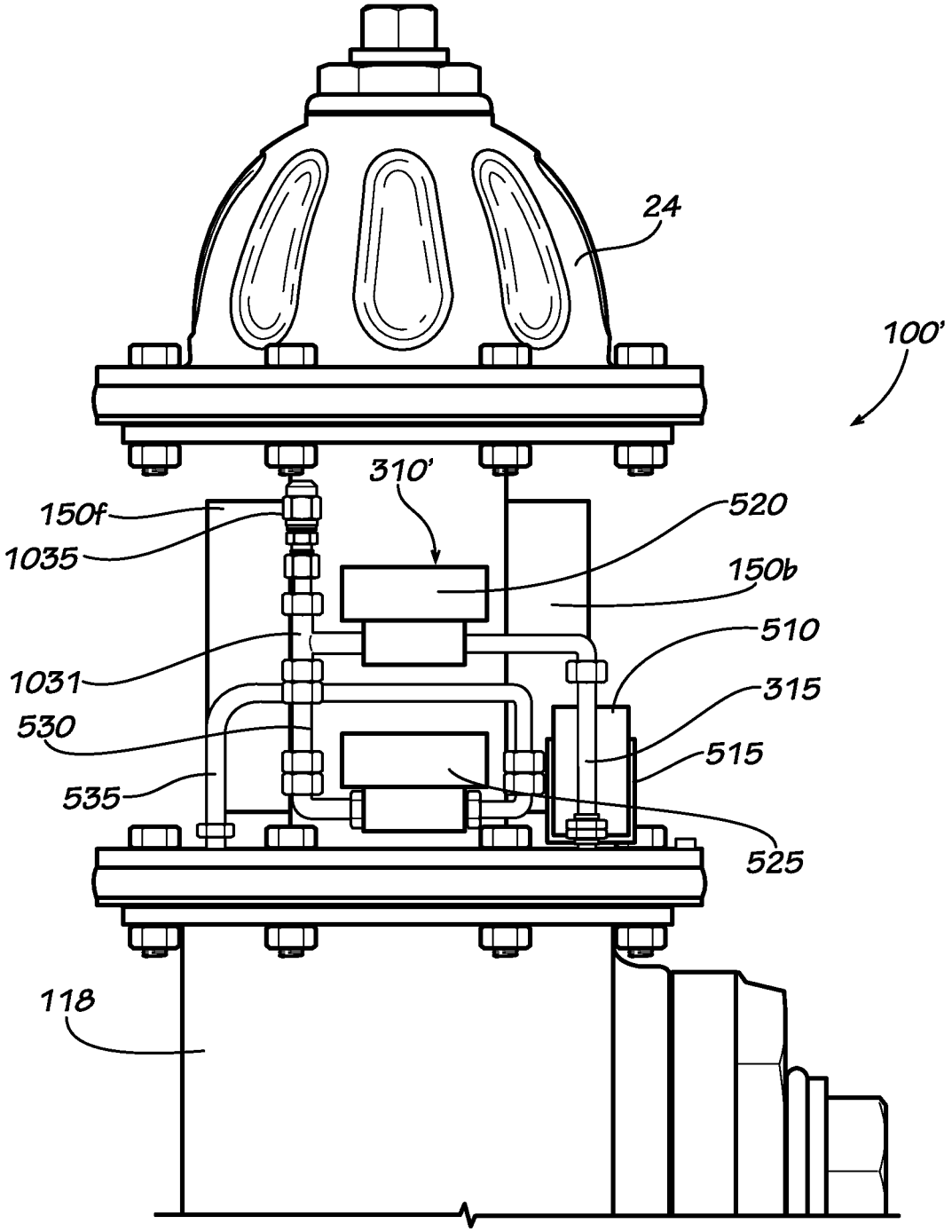
FIG. 13 is a side view of one embodiment of a flushable hydrant without a shroud.

Another embodiment of a flushable hydrant 100' is shown in FIG. 13. The flushable hydrant 100' includes a pressure regulation assembly 310'. Pressure regulation assembly 310' may be similar to pressure regulation assembly 310 except that pressure regulation assembly 310' also includes a manual bleed valve 1035 mounted between the gas intake valve 520 and the gas discharge valve 525. The manual bleed valve 1035 is connected to a tee joint 1031, which is also connected to the gas intake valve 520 and the gas discharge valve 525, though the location of the manual bleed valve 1035 between the gas intake valve 520 and the gas discharge valve 525 should not be considered limiting. In the current embodiment, the manual bleed valve 1035 is a manual piston purge valve, though other manual bleed valves 1035 may be used in other embodiments. In some embodiments, the manual piston purge valve may comprise Parker Instrumentation model number 4Z-PG4L-SS, though other manual piston purge valves may be used in various embodiments.

It is possible that pressure may be prevented from being vented through the exhaust line 535. For example, the gas intake valve 520 and the gas discharge valve 525 may be stuck in the closed position after the fluid valve is opened. In another example, an obstruction may block the exhaust line 535 after the fluid valve is opened and the gas discharge valve 525 is thereafter opened to vent the compressed gas to close the fluid valve. In another example, the gas intake valve 520 may open due to a malfunction and the chamber 199 is unintentionally pressurized. In these situations, as well as any other situation where it is intended that pressure be released and it is not possible or desirable to vent through the exhaust line 535, the manual bleed valve 1035 may be opened to release the pressure. In the current embodiment, the manual piston purge valve may be opened by use of a wrench. In other embodiments, the manual bleed valve 1035 may be operated by other methods, including remote operation, use of a screw driver, movement of a purge needle within the manual bleed valve 1035, or any other method.

It should be emphasized that the embodiments described herein are merely possible examples of implementations, merely set forth for a clear understanding of the principles of the present disclosure. Many variations and modifications may be made to the described embodiment(s) without departing substantially from the spirit and principles of the present disclosure. For example, compressed gas is but one method of actuation among many, including hydraulic, electromechanical, and gravitational, among others. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

One should note that conditional language, such as, among others, "can," "could," "might," or "may," unless specifically stated otherwise, or otherwise understood within the context as used, is generally intended to convey that certain embodiments include, while alternative embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

The invention claimed is:

1. A device for flushing a hydrant comprising:

a stem connected to a fluid valve of the hydrant; and an actuation system including:

a biased translational system coupled to the stem;

a compressed gas;

a normally-open gas discharge valve;

a normally-closed gas intake valve and a hold down assembly coupled to the stem and defining a pressure cavity in fluid communication with the normally-open gas discharge valve and the normally-closed gas intake valve, the pressure cavity including a piston plate within the pressure cavity.

2. The device of claim 1, wherein the gas discharge valve includes a solenoid and a pneumatic valve, the pneumatic valve closable by the solenoid.

3. The device of claim 1, wherein the hold down assembly includes a stem body defining a bias cavity and the pressure cavity, wherein:

within the bias cavity, a biasing element of the biased translational system is seated; and within the pressure cavity, a piston assembly includes the piston plate, a cylinder body, a bottom plate, and a bottom plate stop, wherein the piston plate separates the pressure cavity into a top chamber and a bottom chamber, wherein the top chamber and bottom chambers are sealed, and wherein the top chamber is in fluid communication with the normally-open gas discharge valve and the normally-closed gas intake valve.

4. The device of claim 1, wherein the actuation system includes at least one gas container.

5. The device of claim 1, wherein the hold down assembly includes a stem body coupled to the stem.

6. The device of claim 5, wherein the stem body defines the pressure cavity.

7. The device of claim 6, wherein the stem body includes a piston assembly within the pressure cavity, the piston assembly including the piston plate.

8. The device of claim 1, wherein the biased translation system includes a biasing element.

9. The device of claim 8, wherein the biasing element is a spring, the spring surrounding the stem.

10. An actuation system for flushing a hydrant comprising:

a fluid;

a piston assembly movable by the fluid, the piston assembly including a piston plate within a pressure cavity defined in a hold down assembly;

a normally-open fluid discharge valve in fluid communication with the pressure cavity;

a normally closed fluid intake valve in fluid communication with the pressure cavity;

a manual bleed valve in fluid communication with the pressure cavity; and a biasing element at least indirectly biasing the piston assembly towards a stop position.

11. The actuation system of claim 10, wherein the manual bleed valve is a manual piston purge valve.

12. The actuation system of claim 11, wherein the manual piston purge valve is openable by a wrench.

13. The actuation system of claim 10, wherein the hold down assembly is mountable on a hydrant.

14. The actuation system of claim 10, wherein the fluid is compressed gas.

15. The actuation system of claim 14, further comprising at least one gas container.

16. A method of flushing a hydrant comprising:

operating an actuation system coupled to the hydrant, the actuation system including a compressed gas, a normally-open gas discharge valve, a normally-closed gas intake valve, a piston assembly coupled to a stem of the hydrant and including a piston plate within a pressure cavity defined in a hold down assembly, the pressure cavity in fluid communication with the normally-open gas discharge valve and the normally-closed gas intake valve, and a biasing element coupled to the stem, the stem connected to a fluid valve of the hydrant;

closing the normally-open gas discharge valve; and opening the fluid valve of the hydrant by pressurizing one side of a piston plate of the piston assembly with the compressed air.

17. The method of claim 16, further comprising closing the fluid valve of the hydrant by opening the normally-open gas discharge valve, wherein opening the normally-open gas discharge valve releases pressure from against the one side of the piston plate.

18. The method of claim 16, wherein the piston assembly is mounted within a pressure cavity defined within a stem body coupled to the stem.

19. The method of claim 16, wherein opening the fluid valve includes opening the normally-closed gas intake valve of the actuation system.

20. The method of claim 16, wherein the normally-open gas discharge valve includes a solenoid, and wherein closing the normally-open gas discharge valve includes powering the solenoid.

* * * * *